US007708185B2

(12) United States Patent
Kato

(10) Patent No.: US 7,708,185 B2
(45) Date of Patent: May 4, 2010

(54) PLASTIC BOX

(75) Inventor: Kyoichi Kato, Tokyo (JP)

(73) Assignee: Kao Corporation, Tokyo (JP)

( * ) Notice: Subject to any disclaimer, the term of this patent is extended or adjusted under 35 U.S.C. 154(b) by 1043 days.

(21) Appl. No.: 10/577,253

(22) PCT Filed: Nov. 18, 2005

(86) PCT No.: PCT/JP2005/021234

§ 371 (c)(1),
(2), (4) Date: Apr. 26, 2006

(87) PCT Pub. No.: WO2006/059499

PCT Pub. Date: Jun. 8, 2006

(65) Prior Publication Data

US 2009/0101702 A1 Apr. 23, 2009

(30) Foreign Application Priority Data

Dec. 1, 2004 (JP) ..... 2004-348208

(51) Int. Cl.
*B65D 5/10* (2006.01)

(52) U.S. Cl. ..... 229/102; 229/153; 229/160.2

(58) Field of Classification Search ..... 229/102, 229/148, 152, 153, 160.2
See application file for complete search history.

(56) References Cited

U.S. PATENT DOCUMENTS

| | | | | |
|---|---|---|---|---|
| 312,851 | A * | 2/1885 | Heron | 229/160 |
| 581,234 | A * | 4/1897 | Keeler | 229/160 |
| 1,079,583 | A * | 11/1913 | Seegmiller | 229/148 |
| 1,830,420 | A * | 11/1931 | Blitz | 229/151 |
| 1,989,659 | A * | 2/1935 | Adsit et al. | 229/153 |
| 2,630,962 | A * | 3/1953 | Wasyluka | 229/151 |
| 3,370,775 | A * | 2/1968 | Link | 229/160.2 |
| 3,484,034 | A * | 12/1969 | Sternau | 229/160.2 |
| 4,809,908 | A * | 3/1989 | Keefe et al. | 229/153 |
| 4,978,009 | A * | 12/1990 | Pany | 229/152 |
| 5,707,004 | A * | 1/1998 | Cai | 229/148 |
| 6,957,765 | B2 * | 10/2005 | Howell et al. | 229/151 |

FOREIGN PATENT DOCUMENTS

| | | | |
|---|---|---|---|
| EP | 430013 A1 * | 6/1991 | 229/152 |
| JP | 52-45468 | 4/1977 | |
| JP | 6-42632 | 6/1994 | |
| JP | 8-72866 | 3/1996 | |
| JP | 2003-327242 | 11/2003 | |

* cited by examiner

*Primary Examiner*—Gary E Elkins
(74) *Attorney, Agent, or Firm*—Oblon, Spivak, McClelland, Maier & Neustadt, L.L.P.

(57) ABSTRACT

A plastic box formed of plastic that closes an opening by bending inner Flaps, arranged on one pair of opposite two sides at a periphery of the opening, towards the inside, and folding an outer flap arranged on one side of the other pair of opposite two sides, while inserting and latching an insertion flap piece into the inside of the opening. The plastic box includes a lock mechanism that functions by engaging respective base end parts of the inner flap with notches formed on respective end parts of a bend line bent from the outer flap of the insertion flap piece. In addition, the plastic box includes a finger-receiving brim piece protruding from the bend line towards the outside at a position shifted from the center of the bend line towards the side edge.

9 Claims, 2 Drawing Sheets

PLASTIC BOX

TECHNICAL FIELD

The present invention relates to a plastic box, in particular, a plastic box that closes the opening by bending a pair of inner flaps, which are provided so as to stretch to the edge of the square opening, towards the inside, folding an outer flap onto the inner flaps, and then inserting and latching an insertion flap piece, provided on the end of the outer flap, into the inside of the opening.

BACKGROUND ART

As packaging boxes in which, for example, cosmetics, medicines, confections, stationary and other daily use products are packaged, plastic boxes are widely used in place of paper boxes formed of conventional thick paper or cardboard. A plastic box is often used as a container that is transparent or gives the impression of transparency, and as a packaging box that allows the contents or decorations inside the box to be seen from the outside. The plastic box is preferably formed into a hexahedral shape by an easily assembling process, for example, by bending a plastic sheet which has been formed into a predetermined shape by cutting, along bend lines and then joining at suitable locations.

When assembling a plastic box into a hexahedral shape, a tubular body opened at the upper and lower ends and with a square cross section is assembled using side walls surrounding four directions, and then the bottom surface portion and the upper surface portion are formed by bending inner flaps and outer flaps, provided so as to stretch to the upper edge and the lower edge of the side walls, thereby closing the square opening. In other words, the opening is closed by bending the inner flaps, arranged on one pair of opposite two sides at the periphery of the square opening, towards the inside, and folding the outer flap, provided with an insertion flap piece and arranged on one side of the other pair of opposite two sides, onto the outer side of the folded inner flaps, while inserting and latching the insertion flap piece into the inside of the opening between the other side of the other pair of opposite two sides and the bent inner flap, thereby closing the opening portion and forming the bottom surface portion and the upper surface portion.

In contrast, because the plastic has elasticity, when assembling a plastic box into a hexahedral shape, each surface of the box body assembled in a solid shape by bending along a bending line tends to curve compared to a paper box. Because of this, even though the insertion flap piece is simply inserted into the inside of the opening to form the bottom surface portion or the upper surface portion, the elasticity of the plastic makes it easy to extract the insertion flap piece from the inside of the opening. Consequently, this plastic box has an objective of preventing the insertion flap piece from being extracted in this manner and is provided with a lock mechanism that functions by forming latching notches on respective end parts of the bend line from the outer flap of the insertion flap piece and then latching the base end parts of the inner flap to these notches.

Because the upper surface portion of the plastic box assembled into a hexahedral shape must mainly open and close to allow items to be placed in and taken out of the box, lock mechanisms have been developed taking into consideration the ease of opening and closing the plastic box (as an example refer to Japanese Utility Model Laid-Open Publication No. Hei 6-42632).

DISCLOSURE OF THE INVENTION

The present invention provides a plastic box formed of a plastic that closes a square opening by bending inner flaps, arranged on one pair of opposite two sides at a periphery of the square opening, towards the inside, and folding an outer flap, provided with an insertion flap piece and arranged on one side of the other pair of opposite two sides, while inserting and latching the insertion flap piece into the inside of the opening between the other side of the other pair of opposite two sides and the bent inner flap. This plastic box is provided with a lock mechanism that functions by engaging respective base end parts of the inner flaps with notches formed on respective end parts of a bend line bent from the outer flap of the insertion flap piece. In addition, this plastic box is provided with a finger-receiving brim piece protruding from the bend line towards the outside at a position shifted from the center of the bend line towards the side edge.

DETAILED DESCRIPTION OF THE INVENTION

The lock mechanism disclosed in Japanese Utility Model Laid-Open Publication No. Hei 6-42632 is provided with a protrusion protruding towards the inside to latch the side edge of the inner flap piece close to the bend line from the outer flap at both side edge parts of the insertion flap piece. When the insertion flap piece is inserted into the inside of the square opening and the opening is closed, this lock mechanism functions by latching the side edge of the inner flap piece bent in advance onto the protrusion while the inner flap piece rides up onto the protrusion due to its flexibility. However, in the lock mechanism of Japanese Utility Model Laid-Open Publication No. Hei 6-42632, while the opening and closing of the plastic box easy, it is difficult to make a tall protrusion. Thus, the latching force is weak. In some cases, it may be impossible to stably lock a plastic box whose surfaces tend to curve due to the elasticity of the plastic when the opening is in a closed state.

An object of the present invention is to provide a plastic box which allows to close a square opening in a reliable and stable locked state using a pair of inner flaps and an outer flap provided with an insertion flap piece and to smoothly release the locked state thereby easily removing and inserting items.

The present invention provides a plastic box formed of a plastic that closes a square opening by bending inner flaps, arranged on one pair of opposite two sides at a periphery of the square opening, towards the inside, and folding an outer flap, provided with an insertion flap piece and arranged on one side of the other pair of opposite two sides, while inserting and latching the insertion flap piece into the inside of the opening between the other side of the other pair of opposite two sides and the bent inner flap. This plastic box is provided with a lock mechanism that functions by engaging respective base end parts of the inner flaps with notches formed on respective end parts of a bend line bent from the outer flap of the insertion flap piece. In addition, this plastic box is provided with a finger-receiving brim piece protruding from the bend line towards the outside at a position shifted from the center of the bend line towards the side edge.

Figure 1A:
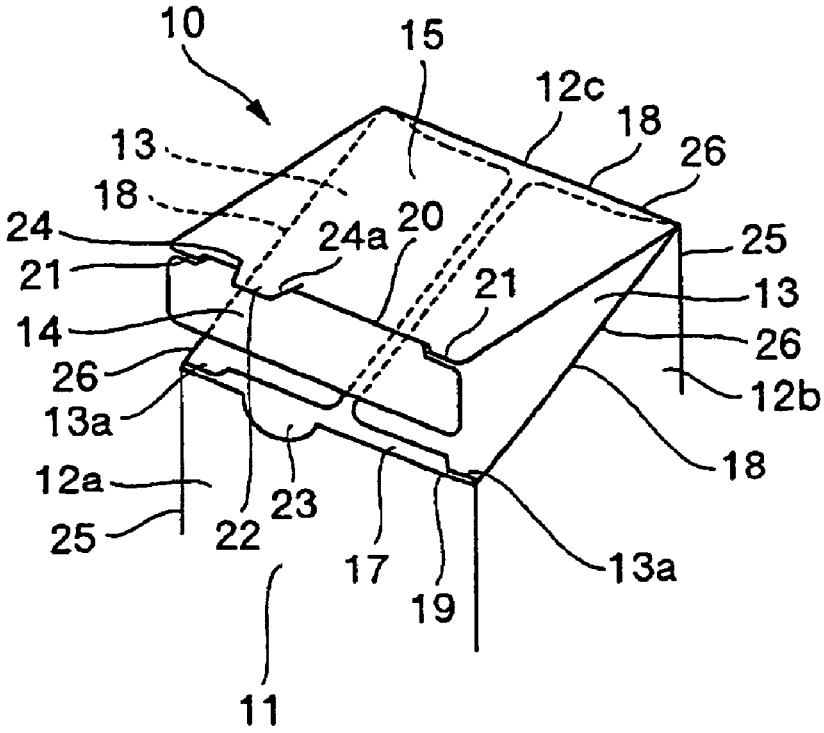
FIG. 1(*a*) and FIG. 1(*b*) are principal part perspective views showing the opening of the upper surface portion in a closing state to describe the configuration of the plastic box according to one preferred embodiment of the present invention.
Figure 1B:
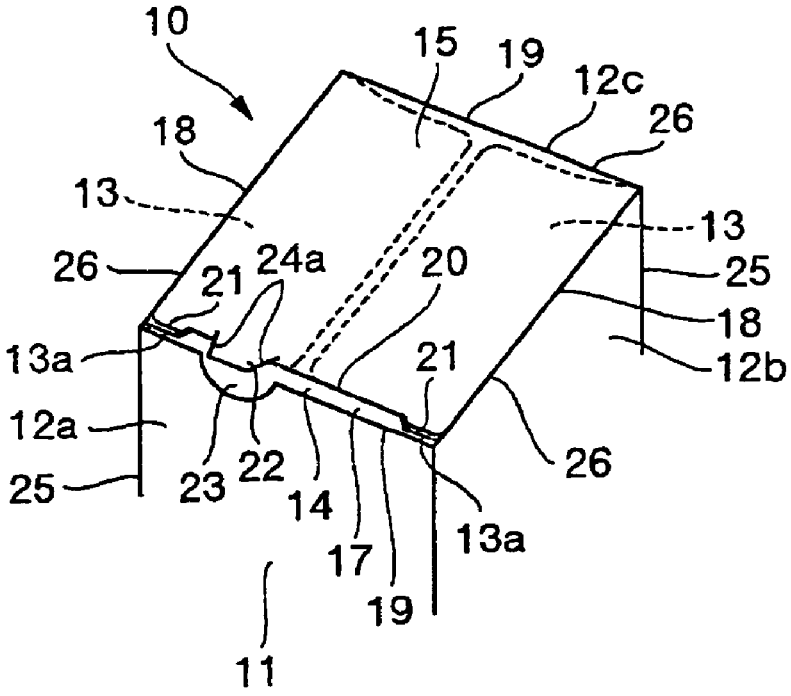
Figure 2:
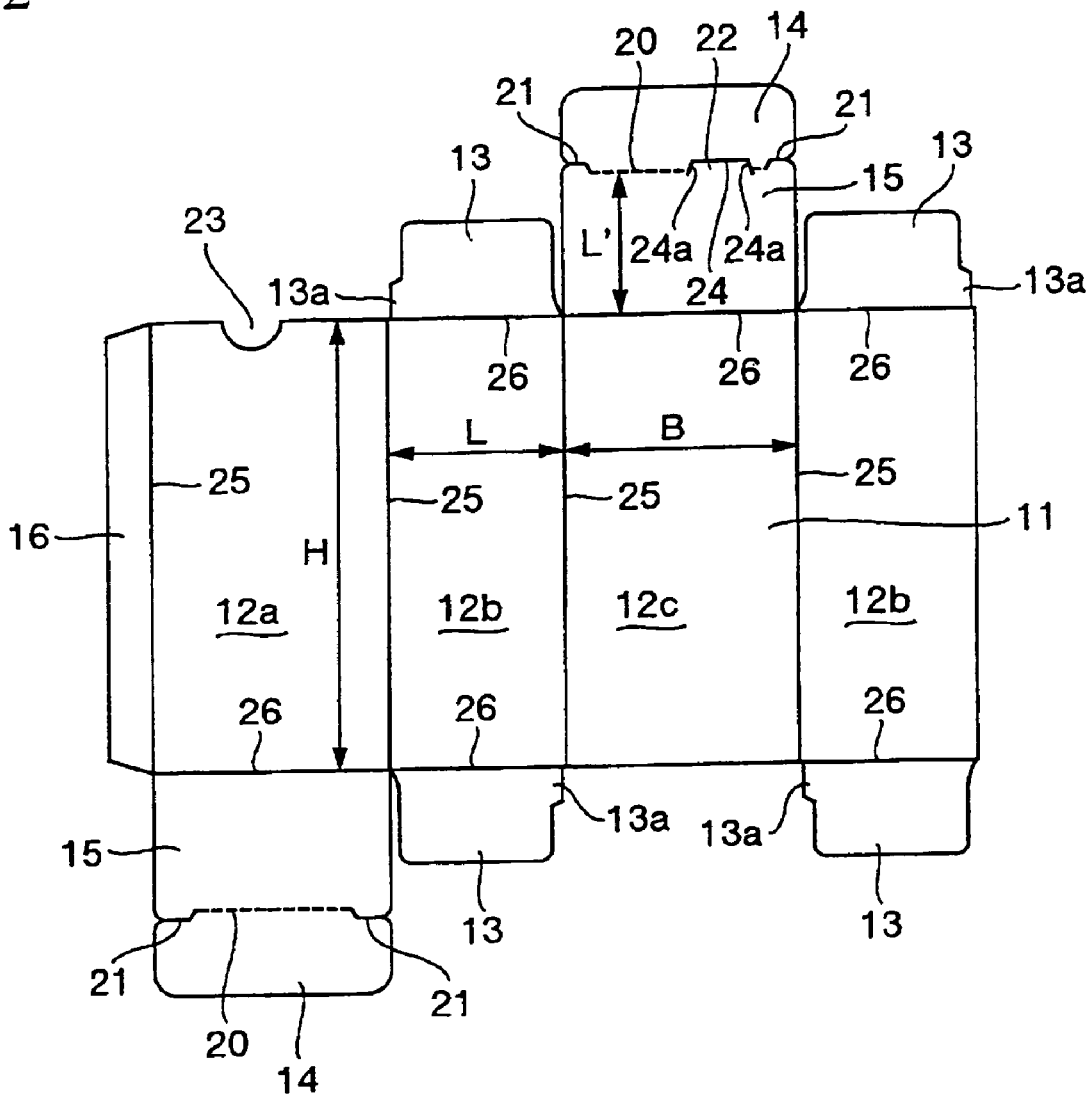
FIG. 2 is a plan view showing the expanded shape of the plastic sheet that constitutes the plastic box according to one preferred embodiment of the present invention.

As shown in FIG. 1(*a*), FIG. 1(*b*), and FIG. 2, a plastic box 10 according to one preferred embodiment of the present invention is used as a packaging box that contains cosmetics as its content. The plastic box 10 is made by bending plastic sheet 11, formed by cutting into a predetermined shape, and assembling the sheet into a three-dimensional shape. The plastic box 10 is formed in such a manner that a tubular body with a square cross section enclosed at four sides using a front facing side wall 12*a*, a pair of side facing side walls 12*b*, and a rear facing side wall 12*c* is formed, and then square openings 17 of upper and bottom surface portions of the tubular body are each closed using a pair of inner flaps 13, and an outer flap 15 provided with an insertion flap piece 14, described later. As a result, the plastic box takes a hexahedral shape, or an oblong rectangular parallelepiped shape with a width B of 25 to 60 mm, a depth L of 20 to 60 mm, and a height H of 80 to 180 mm, for example.

Furthermore, the plastic box 10 of the embodiment is a plastic packaging box formed of a plastic that closes the square opening 17 of the upper surface portion, for example, by bending inner flaps 13, arranged on one pair of opposite two sides (upper sides of the side facing side walls 12*b*) 18 at a periphery of the square opening 17, and folding an outer flap 15, provided with an insertion flap piece 14 and arranged on one side of the other pair of opposite two sides 19 (an upper side of the rear facing side wall 12*c*), while inserting and latching the insertion flap piece 14 into the inside of the opening 17 between the other side of the other pair of opposite two sides 19 (an upper side of the front facing side wall 12*a*) and the bent inner flap 13. This plastic box 10 is also provided with a lock mechanism that functions by engaging base end parts 13*a* of the inner flaps 13 to the notches 21 formed on respective end parts of the bend line 20 (insertion bend line) bent from the outer flap 15 of the insertion flap piece 14. In addition, this plastic box is provided with a finger-receiving brim piece 22 protruding from this insertion bend line 20 towards the outside at a position shifted from the center of the insertion bend line 20 towards the side edge.

In this embodiment, the other side of the other pair of opposite two sides 19 (the upper side of the front facing side wall 12*a*), where the insertion flap piece 14 is inserted, is cut out and a finger guide cutout 23 is formed on the front facing side wall 12*a* at the position where the finger-receiving brim piece 22 faces.

Furthermore, in this embodiment, the finger-receiving brim piece 22 is provided protruding from the insertion bend line 20 towards the outside by forming a notch 24 with a right-angled U shape (shape like "]") for a brim piece that includes a pair of notch lines 24*a* which intersect the insertion bend line 20 between the outer flap 15 and the insertion flap piece 14.

The plastic sheet 11 used to form the plastic box 10 of this embodiment is a thin plate-like sheet material composed of, for example, polypropylene, polyethylene terephthalate, polyvinyl chloride, or polystyrene as a plastic and has a preferable thickness of 0.3 to 0.5 mm and even more preferably 0.35 to 0.45 mm. The plastic sheet has enough stiffness and elasticity to allow the sheet to easily maintain a smooth curved shape without bending when the side edge of the plastic sheet is held in a cantilever fashion and is horizontally extended, and has deformation properties which allow the sheet to be easily bent by the force of hand.

In addition, the plastic sheet 11 is formed, for example, by punching so as to have a shape, as shown in FIG. 2, that is derived from the plastic box 10. The plastic sheet 11 is provided with bend lines 25 and 26 formed by, for example, a half-cut line or ruled line and notches 21 and 24 formed by, for example, a full-cut line, at suitable positions. This makes it possible to easily assemble the box into a hexahedral shape. In other words, the oblong rectangular side facing side walls 12*b* are arranged on both sides of the oblong rectangular rear facing side wall 12*c* through the lengthwise bend lines 25. The oblong rectangular front facing side wall 12*a* is arranged on the side of one of the side facing side walls 12*b* through the lengthwise bend line 25. An oblong strip-shaped junction piece 16 is also arranged on the side of the front facing side wall 12*a* through the lengthwise bend line 25. Even further, inner flaps 13 are arranged at the upper end and the lower end of each of the side facing side walls 12*b* through the crosswise bend lines 26, respectively, while outer flaps 15, each provided with the insertion flap piece 14, are arranged at the upper end of the rear facing side wall 12*c* and at the lower end of the front facing side wall 12*a* through the crosswise bend lines 26, respectively.

In this embodiment, the notch 24 with a right-angled U shape for the brim piece that includes the pair of notch lines 24*a* which intersect the insertion bend line 20, is formed at the insertion bend line 20 between the insertion flap piece 14 and the outer flap 15 arranged over the rear facing side wall 12*c*, and is arranged at a position shifted from the center of the insertion bend line 20 towards the side edge. This brim piece notch 24 is arranged such that the center of the brim piece notch 24 is positioned in a region of ⅕ or more and less than ½ of the length of the bend line 20 (in this embodiment a position of approximately ⅓ the length of the bend line 20) from the side edge of the insertion bend line 20, for example. The brim piece notch 24 is formed in such a manner that the open side with a right-angled U shape is directed to the rear facing side wall 12*c* to allow the closed side with a right-angled U shape to cut into the flap piece 14. This makes the finger-receiving brim piece 22 protrude from the insertion bend line 20 with a width of, for example, 5 to 20 mm and a protrusion length of, for example, 0.5 to 2.0 mm (in this embodiment a width of approximately 10 mm and a protrusion length of approximately 1 mm) along the surface direction of the outer flap 15, when the insertion flap piece 14 is bent through the insertion bend line 20.

Hereupon, stress is concentrated on one of the locked portions by arranging the center of the finger-receiving brim piece 22, formed by the brim piece notch 24, in a region of ⅕ or more and less than ½ of the length of the insertion bend line 20, and preferably ⅕ to 4/9, and more preferably 2/7 to ⅖, and even more preferably 2/7 to 4/11, from the side edge of the insertion bend line 20, thereby making it possible to easily release the locked state. The finger-receiving brim piece 22 can be firmly caught with a fingertip by providing the finger-receiving brim piece 22 with a width of 5 to 20 mm and a protrusion length of 0.5 to 2.0 mm along the surface direction of the outer flap 15.

In this embodiment, a distance L' of the outer flap 15 between the crosswise bend line 26 and the insertion bend line 20 becomes, for example, approximately 1.0 to 2.0 mm shorter than the width of the side facing side wall 12*b*, that is same with the depth L of the plastic box 10, so that the insertion bend line 20 except the both end parts where the notch 21 is formed is shifted into the side of the rear facing side wall 12*c* from the periphery of the square opening at the front facing side wall 12*a*. Because of this, when the opening 17 is closed and locked by the inner flaps 13 and the outer flap 15 (refer to FIG. 1(*a*) and FIG. 1(*b*)), both end parts of the insertion flap piece 14 which are separated from the outer flap 15 by the notches 21 can be smoothly inserted under the base end parts 13*a* of the inner flaps 13. It is also possible to ensure a sufficient engaging width and obtain an even more stable locked state. Furthermore, when the opening 17 is closed by the outer flap 15, a gap of approximately 0.5 to 5.0 mm, for example, is maintained between the insertion bend line 20 where the finger-receiving brim piece 22 protrudes, and the upper side 19 of the front facing side wall 12*a*. Therefore, the finger-receiving brim piece 22 does not protrude from the extended surface of the front facing side wall 12*a*, making it possible to eliminate obstructions caused by the protrusion.

Additionally, in this embodiment, the notches 21 formed on respective end parts of the insertion bend line 20 are provided with a length of 3 to 5 mm, for example, and are connected to the insertion bend line 20 through the notch portion that extends diagonally to the insertion bend line 20. The base end parts 13*a* of the inner flaps 13 have same length with the notches 21 and are provided as widening parts that widen the width by one level from the side edge of the inner flap 13. This base end parts 13*a* are inserted into the notches 21 and are then engaged by the elasticity of the inner flap 13 and the insertion flap piece 14, forming a firm and stable lock mechanism along with the notches 21.

Even further, in this embodiment, the upper edge of the front facing side wall 12*a* which serves as the other side 19 of the opening 17 where the insertion flap piece 14 is inserted is cut out, to form the semicircular finger guide cutout 23 with a cutout width of approximately 7 to 22 mm, for example. The semicircular finger guide cutout 23 is, for example, arranged at a position shifted from the center of the upper edge of the front facing side wall 12*a* towards the side edge corresponding to the position of the finger-receiving brim piece 22, so that the center of the finger guide cutout 23 is arranged in, for example, a region of ⅕ or more and less than ½ of the length of the upper edge from the side edge, and preferably ⅕ to ⅘, and more preferably 2/7 to ⅖, and even more preferably 2/7 to 4/11 (in this embodiment a position of approximately ⅓ the length of the upper edge) from the side edge. Because of this, the finger-receiving brim piece 22 protruding from the insertion bend line 20 is arranged to face the cutout width of the finger guide cutout 23 and meet the finger guide cutout 23, when the opening 17 is closed and locked by the inner flaps 13 and the outer flap 15 (FIG. 1(*a*) and FIG. 1(*b*)).

In order to assemble the plastic box 10 using the plastic sheet 11 formed as described above, at first, the four sides are enclosed by the front facing side wall 12*a*, the pair of side facing side walls 12*b*, and the rear facing side wall 12*c*, by bending each lengthwise line 25 approximately 90 degrees and joining the junction piece 16 along one of the side facing side walls 12*b*, using, for example, an adhesive agent or by means of thermal welding, thereby forming a tubular body with a square cross section. Thereafter, the inner flaps 13 arranged on one pair of opposite two sides (lower sides of the side facing side walls 12*b*) at a peripheral edge of the square opening (not shown in the figure) on the bottom surface portion of this tubular body are bent towards the inside, the outer flap 15, provided with the insertion flap piece 14 and arranged on one side of the other pair of opposite two sides (lower side of the front facing side wall 12*a*) is folded, and then the insertion flap piece 14 is inserted into the inside of the opening to close the opening. At the same time, the base end parts 13*a* of the inner flaps 13 are engaged to the notches 21 formed on respective end parts of the insertion bend line 20 to obtain a firm and stable locked state of the bottom surface portion of the tubular body.

When the bottom surface portion of the plastic box 10 is closed, items such as cosmetics are contained inside the box from the opening 17 of the upper surface portion and, in a like manner to the bottom surface portion, the inner flaps 13, arranged on one pair of opposite two sides 18 (upper sides of the side facing side walls 12*b*) at the peripheral edge of the square opening 17 on this upper surface portion are bent towards the inside, the outer flap 15, provided with the insertion flap piece 14 and arranged on the upper side of the rear facing side wall 12*c* which is one side of the other pair of opposite two sides 19, is folded onto the inner flaps 13, and the insertion flap piece 14 is inserted between the front facing side wall 12*a* on the inside of the opening 17 and the side edges of the inner flaps 13 to close the opening 17. At the same time, the base end parts 13*a* of the inner flaps 13 are engaged to the notches 21 formed on respective end parts of the insertion bend line 20 to thereby obtain a firm and stable locked state of the upper surface portion.

As described above, according to the plastic box 10 of this embodiment, the opening can be closed in a firm and stable locked state by engaging the base end parts 13*a* of the inner flaps 13 to the notches 21 formed on respective end parts of the insertion bend line 20 as well, the closed and locked state of the opening on upper surface portions can smoothly be released, and items can easily be inserted and removed. In other words, according to this embodiment, because the finger-receiving brim piece 22 protruding from the insertion bend line 20 towards the outside is provided at a position shifted from the center of the insertion bend line 20 towards the side edge, when releasing the engaged state between the notches 21 and the base end parts 13*a* of the inner flaps 13, while lifting up the insertion flap piece 14 from the inside of the opening 17 and bending the inner flaps 13 and the insertion flap piece 14 due to the elasticity of them, by sliding a finger upward along the front facing side wall 12*a*, for example, a fingertip can smoothly catch the finger-receiving brim piece 22, and the opening operation can be smoothly performed. Additionally, stress for releasing can be efficiently concentrated only on one side of the lock mechanism, because the finger-receiving brim piece 22 is provided at a position shifted from the center towards the side edge. Consequently, a large force is not required to release the locked state, and it becomes possible to easily open the opening 17 of the upper surface portion and easily insert and remove items, while preventing breakage or loss of the notches 21 provided at respective end parts of the insertion bend line 20.

Even further, according to the plastic box 10 of this embodiment, because the upper edge of the front facing side wall 12*a* is cut out and the finger guide cutout 23 is formed at a position that faces the finger-receiving brim piece 22, a fingertip can smoothly catch the finger-receiving brim piece 22 by affixing a finger to the finger guide cutout 23, and the opening operation is easily performed by sliding the finger upward, even if the finger-receiving brim piece 22 is provided without being protruded from the extended surface of the front facing side wall 12*a*.

The present invention is not limited to the embodiment described above but can be modified in various ways. For example, it is not always necessary to provide a finger guide cutout at a position that faces the finger-receiving brim piece of the front facing side wall. In addition, the finger guide cutout can be formed in various shapes such as a semi ellipse shape, a semi ellipsoidal shape, a rectangular shape, or a triangular shape, besides the semicircular shape. The finger-receiving brim piece does not always have to be provided using a right-angled U-shape notch for a brim piece that intersects the insertion bend line. The finger-receiving brim piece can be separately provided by adhering such piece, for example. In addition, the finger-receiving brim piece does not always have to protrude along the surface direction of the outer flap. Even further, a structure that allows easy opening using the finger-receiving brim piece can be provided not only on the upper surface portion of the plastic box but the bottom surface portion as well, and square shapes of the cross-section and opening of the plastic box are not limited to a rectangular shape, and they may be other square shapes such as a trapezoid square or a regular square.

INDUSTRIAL APPLICABILITY

According to the plastic box of the present invention, the square opening can be closed in a firm and stable locked state using a pair of inner flaps and an outer flap provided with an insertion flap piece, the locked state can be smoothly released, and items can easily be inserted and removed.

The invention claimed is:

1. A plastic box formed of a plastic that closes a square opening by bending inner flaps, arranged on one pair of opposite two sides at a periphery of said square opening, towards an inside of the opening, and folding an outer flap, comprising an insertion flap piece and arranged on one side of an other pair of opposite two sides, while inserting and latching said insertion flap piece into the inside of said opening between an other side of said other pair of opposite two sides and the bent inner flap, the plastic box comprising:

a lock mechanism to engage respective base end parts of said inner flaps to notches formed on respective end parts of a bend line bent from said outer flap of said insertion flap piece and the notches formed on the respective end parts of the bend line extend further outward from the outer flap than the bend line; and a finger-receiving brim piece protruding from said bend line towards an outside of the opening is provided at a position shifted from a center of said bend line towards a side edge.

2. The plastic box according to claim 1, wherein a center of the finger-receiving brim piece is arranged at a position shifted from the center of the bend line in a region of ⅕ or more and less than ½ a length of the bend line from the side edge.

3. The plastic box according to claim 1, wherein said other side, where said insertion flap piece is inserted, is cut out and a finger guide cutout is formed on a front facing side wall of the other pair of opposite two sides at a position where said finger-receiving brim piece faces.

4. The plastic box according to claim 1, wherein said finger-receiving brim piece is provided protruding from said bend line towards the outside by forming a notch with a right-angled U shape for the finger-receiving brim piece that includes a pair of notch lines which intersect the bend line from said outer flap of said insertion flap piece.

5. The plastic box according to claim 1, wherein said finger-receiving brim piece is provided protruding at a width of 5 to 20 mm and a protruding length of 0.5 to 2.0 mm along a surface direction of said outer flap.

6. The plastic box according to claim 1, wherein a distance of the outer flap between the bend line and an opposite edge of the outer flap is shorter than a width of the one pair of opposite two sides on which the inner flaps are arranged.

7. The plastic box according to claim 6, wherein the distance of the outer flap between the bend line and the opposite edge of the outer flap is 1.0 to 2.0 mm shorter than the width of the one pair of opposite two sides on which the inner flaps are arranged.

8. The plastic box according to claim 1, wherein, when the outer flap is in a folded position to close the opening, a gap between the finger-receiving brim piece protruding from the bend line and an upper edge of a front facing side wall of the other pair of opposite two sides is 0.5 to 5.0 mm.

9. The plastic box according to claim 1, wherein the notches formed on the respective end parts of the bend line have a length that is equal to a length of the respective base end parts of the inner flaps to which the notches are engaged.

* * * * *